United States Patent [19]

Taylor

[11] Patent Number: 4,991,232

[45] Date of Patent: Feb. 12, 1991

[54] SURGICAL GOWN AND METHOD OF MAKING SAME

[75] Inventor: Jeffrey L. Taylor, Cincinnati, Ohio

[73] Assignee: Standard Textile Company, Inc., Cincinnati, Ohio

[21] Appl. No.: 371,989

[22] Filed: Jun. 27, 1989

[51] Int. Cl.[5] ..... A41D 13/00

[52] U.S. Cl. ..... 2/51; 2/114; 2/115; 2/125; 2/DIG. 7

[58] Field of Search ..... 2/49 R, 50, 51, 113, 2/114, 115, 118, 125, 84, 85, 90, 93, 87

[56] References Cited

U.S. PATENT DOCUMENTS

| | | | |
|---|---|---|---|
| 2,021,714 | 11/1935 | Cole | 2/115 |
| 2,319,085 | 5/1943 | Plant | 2/87 |
| 2,743,450 | 5/1956 | Kling | 2/DIG. 2 X |
| 2,818,573 | 1/1958 | O'Donnell | 2/114 |
| 3,045,815 | 7/1962 | Abildgaard | 2/114 X |
| 3,349,285 | 10/1967 | Belkin | 2/114 X |
| 3,868,728 | 3/1975 | Krezewinski | 2/DIG. 7 X |
| 3,916,447 | 11/1975 | Thompson | 2/DIG. 7 |
| 4,017,909 | 4/1977 | Brandriff | 2/114 |
| 4,171,542 | 10/1979 | Cox et al. | 2/114 X |
| 4,504,977 | 3/1985 | King et al. | 2/114 X |
| 4,504,978 | 3/1985 | Gregory, Jr. et al. | 2/114 |
| 4,555,811 | 12/1985 | Shimalla | 2/51 |
| 4,586,196 | 5/1986 | White | 2/DIG. 7 |
| 4,622,699 | 11/1986 | Spriggs | 2/114 |
| 4,698,848 | 10/1987 | Buckley | 2/114 |
| 4,718,124 | 1/1988 | Sawicki et al. | 2/DIG. 7 |
| 4,736,467 | 4/1988 | Schwarze et al. | 2/114 |

*Primary Examiner*—Werner H. Schroeder
*Assistant Examiner*—Jeanette E. Chapman
*Attorney, Agent, or Firm*—Kinney & Schenk

[57] ABSTRACT

A hospital-type gown, such as a surgical gown, and method of making same are provided wherein such gown has a main body comprised of a front panel with a pair of side panels on opposite sides of the front panel and a pair of sleeves fastened to the panels and each terminating in a cuff at the terminal outer end with the front panel and each of the sleeves comprising a plurality of plies and the plurality of plies serving as an improved barrier against liquids passing therethrough yet being breathable.

19 Claims, 2 Drawing Sheets

SURGICAL GOWN AND METHOD OF MAKING SAME

BACKGROUND OF THE INVENTION

1. Field of the Invention

This invention relates to a hospital-type gown which may be in the form of a launderable surgical gown, or the like.

2. Prior Art Statement

Hospital-type gowns, such as surgical gowns, are widely used in hospitals, doctors' offices, clinics, and the like by health professionals such as doctors, medical assistants, nurses, and nurses' aides; and, particularly where there is a possibility of coming into contact with contaminated body fluids, every effort is made to protect the health professional. Health professionals routinely wear surgical gowns of the type disclosed herein to either perform surgery or assist in surgery, draw blood, work with specimens containing contaminated fluids, or work where there might be a spill of contaminated fluids. Especially in instances where patients may have Acquired Immunity Deficiency Syndrome (AIDS), the health professional wants to have as much protection as possible.

Hospital-type gowns, such as surgical gowns, proposed previously usually consist of a main body comprised of a front panel with a pair of side panels on opposite sides of the front panel and a pair of sleeves fastened to the panels and each terminating in a cuff at the terminal outer end thereof. However, the front panel, side panels. and sleeves of such a previously proposed gown are usually single-ply panels and sleeves. Further, the side panels of such a gown are usually attached to the front panel by stitch means or stitches and likewise the sleeves are attached to the front and side panels by stitches. However, it is well known that stitches inherently perforate the materials used to make the front panel, side panels, and sleeves of the gown and thereby provide openings through which a contaminated liquid might pass and reach the wearer of a gown whereby previously proposed gowns are deficient even when such gowns are made of substantially hydrophobic materials due to the single thickness of their panels and sleeves and due to the stitch means which perforate the materials used to make such previously proposed gowns resulting in such gowns not providing optimum protection against liquid permeating therethrough.

SUMMARY OF THE INVENTION

This invention provides a new hospital-type gown such as a surgical gown for health professionals, and the like, which helps correct the above-mentioned deficiency.

In particular, this invention provides a new hospital-type gown having a main body comprised of a front panel with a pair of side panels on opposite sides of the front panel and a pair of sleeves fastened to the panels and each terminating in a cuff at the terminal outer end thereof.

In accordance with one embodiment of this invention, such new hospital-type gown comprises a front panel and each of the sleeves comprised of a plurality of plies with the plurality of plies serving as an improved barrier against liquids passing therethrough yet being breathable.

This invention also provides a new launderable surgical gown having a main body comprised of a front panel with a pair of side panels on opposite sides of the front panel and a pair of sleeves fastened to the panels and each terminating in a cuff at the terminal outer end thereof.

In accordance with one embodiment of such new surgical gown, such new surgical gown comprises a front panel and each of the sleeves is comprised of a plurality of plies with the plurality of plies serving as an improved barrier against liquids passing therethrough yet being breathable.

This invention also provides a new launderable surgical gown having a main body comprised of a front panel with a pair of side panels on opposite sides of the front panel and a pair of sleeves fastened to the panels and each terminating in a cuff at the terminal outer end thereof.

In accordance with one embodiment of such new surgical gown such new surgical gown comprises a front panel and each of the sleeves comprised of a plurality of plies of hydrophobic fabric with the plurality of plies serving as an improved barrier against liquids passing therethrough yet being breathable.

This invention also provides a new method of making a hospital-type gown comprising the steps of providing a front panel to comprise a main body of the gown, attaching a pair of side panels on the opposite sides of the front panel to complete the main body, and fastening a pair of sleeves to the panels with each sleeve terminating in a cuff at the terminal outer end thereof.

In accordance with one embodiment of the new method of this invention the step of providing a front panel comprises providing the front panel made of a plurality of plies and the step of fasteing the pair of sleeves comprises fastening such sleeves each comprised of a plurality of plies, with the plurality of plies serving as an improved barrier against liquids passing therethrough yet being breathable.

Accordingly, it is an object of this invention to provide a hospital-type gown of the character mentioned.

Another object of this invention is to provide a surgical gown of the character mentioned.

Another object of this invention is to provide a new method of making a hospital-type gown of the character mentioned.

Other features, objects, uses, and advantages of this invention are apparent from a reading of this description which proceeds with reference to the accompanying drawings forming a part thereof.

BRIEF DESCRIPTION OF THE DRAWINGS

The accompanying drawings show present preferred embodiments of this invention, in which.

DESCRIPTION OF PREFERRED EMBODIMENTS

Figure 1:
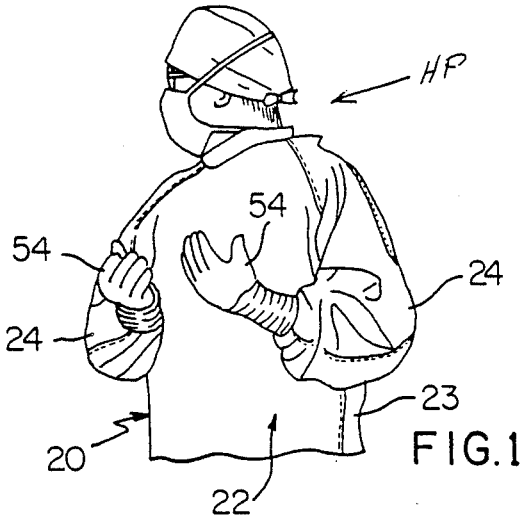
FIG. 1 is a view, with parts broken away, illustrating one exemplary embodiment of a hospital-type gown in the form of a surgical gown being worn by a surgeon with the gown of FIG. 1 having a front panel and each of its sleeves comprised of a plurality of plies.

While the various features of this invention are hereinafter illustrated and described as being particuarly adapted to provide a hospital-type gown for use by health professionals such as surgeons, surgical assistants, surgical nurses, and the like, it is to be understood that the various features of this invention can be utilized singly or in various combinations thereof to provide gowns for other uses as desired.

Therefore, this invention is not to be limited to only the embodiments illustrated in the drawings, because the drawings are merely utilized to illustrate an exemplary one of the wide variety of uses of this invention.

Reference is now made to FIG. 1 of the drawings which illustrates one exemplary embodiment of a hospital-type gown of this invention which is in the form of a surgical gown which is being worn by a health professional (HP); and, such gown is designated generally by the reference numeral 20. The gown 20 is normally utilized by surgeons, surgical nurses, surgical assistants, and the like in hospitals, clinics, doctors' offices, and similar establishments.

Figure 2:
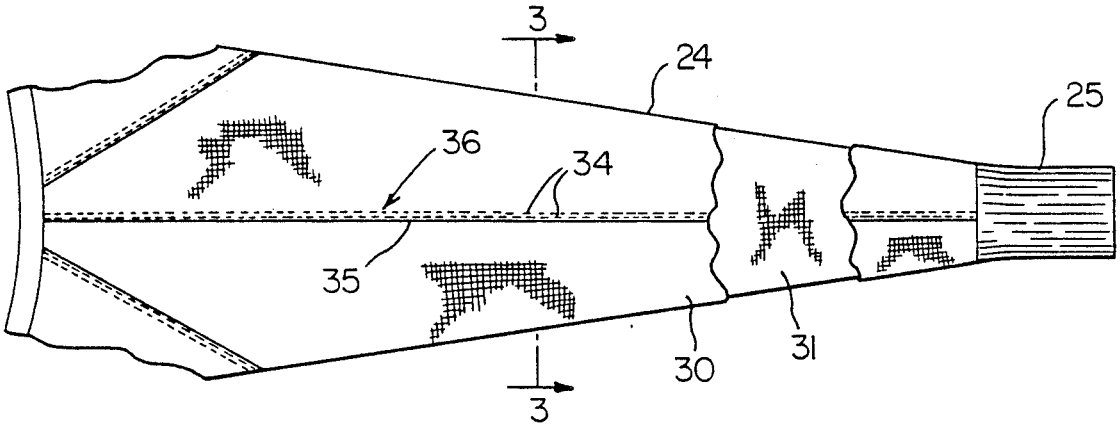
FIG. 2 is a view with parts broken away illustrating a typical sleeve of the gown of FIG. 1 shown in a partially flattened condition.
Figure 4:
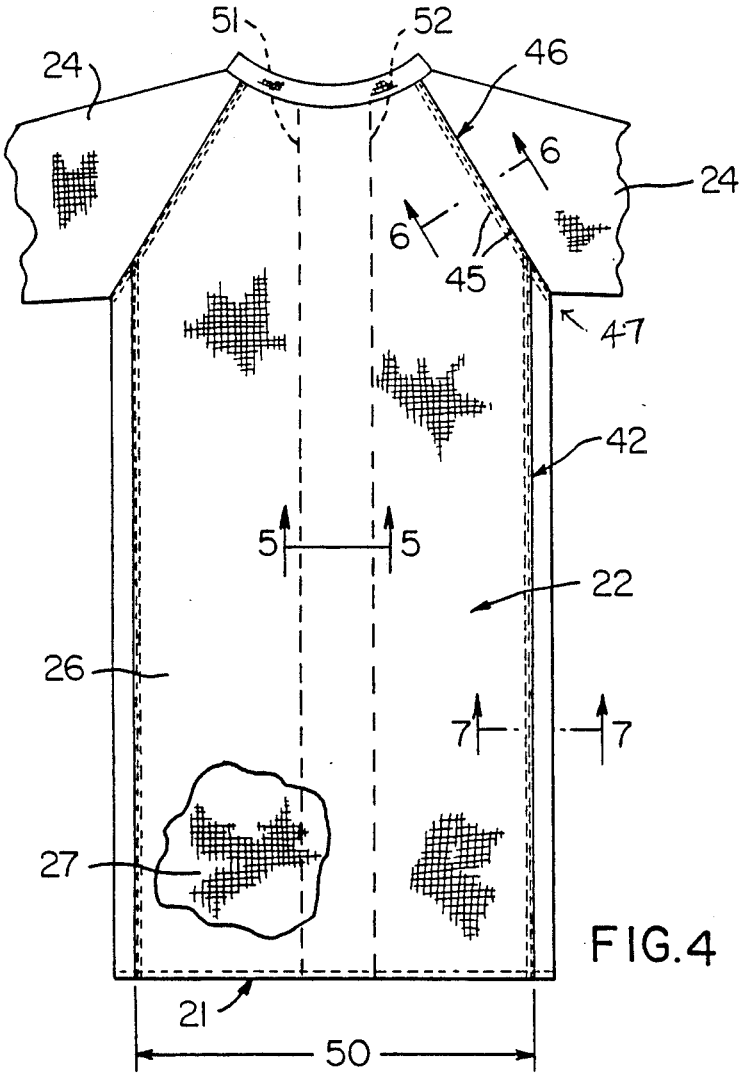
FIG. 4 is a front view of the gown of FIG. 1 shown in a flattened condition and with parts broken away.

The gown 20 is a launderable surgical gown and as best seen in FIG. 4 has a main body 21 comprised of a front panel 22 and a pair of side panels on opposite sides of the front panel with each side panel being designated by the same reference numeral 23. As seen in FIGS. 1 and 4, the gown 20 has a pair of sleeves each designated by the same reference numeral 24 fastened to the panels 22 and 23 and with each of the sleeves terminating in a cuff 25 at the terminal outer end thereof, as best seen in FIG. 2. In accordance with the teachings of this invention, the front panel 22 and each of the sleeves 24 is comprised of a plurality of plies of hydrophobic material with the plurality of plies serving as an improved barrier against liquids passing therethrough yet being breathable.

Figure 5:
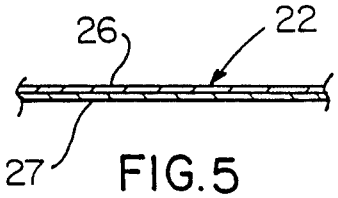
FIG. 5 is a cross-sectional view taken through the front panel essentially on the line 5—5 of FIG. 4.

In particular, and as seen in FIGS. 4 and 5, the front panel 22 is made of a plurality of two plies in the form of an outer ply 26 and an inner ply 27. The plies 26 and 27 are preferably made of a woven fabric material which is a launderable material.

Figure 3:
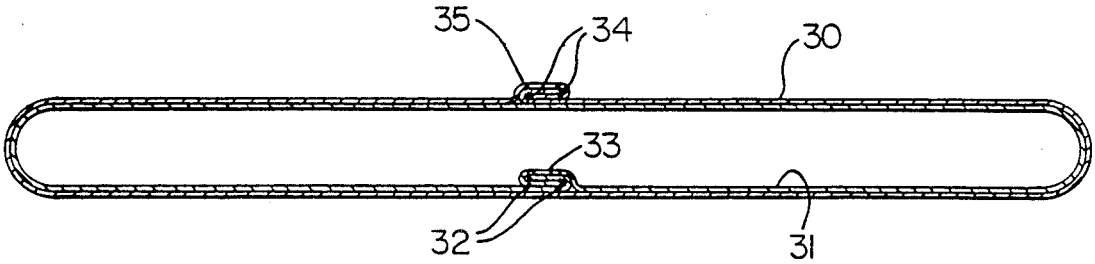
FIG. 3 is a cross-sectional view taken essentially on the line 3—3 of FIG. 2.

As previously mentioned, each of the sleeves is comprised of a plurality of plies; and, as best seen in FIGS. 2 and 3 the plurality of plies of each sleeve consists of two tubular plies shown as an outer ply 30 and an inner ply 31. Each tubular ply is made from a single sheet of material disposed in tubular form and fastened by fastening means which is preferably in the form of stitch means. In particular, the inner ply 31 of each sleeve 24 is fastened by fastening means in the form of stitch means or stitches 32 (FIG. 3) extending through a suitable seam 33 defined at opposite side edges of the single sheet defining inner ply 31. Similarly, the outer ply 30 of each sleeve 24 is fastened by fastening means in the form of stitch means or stitches 34 extending through a suitable seam 35 defined at opposite side edges of the single sheet defining outer ply 30. The seams 33 and 35 may be of any suitable type known in the art.

As will be readily apparent in FIGS. 2 and 3 of the drawings, the stitch means of each tubular ply, namely, outer ply 30 and inner ply 31 of each sleeve 24 extends longitudinally along its sleeve as shown at 36. Preferably the stitch means of one tubular ply is what will be referred to as circumferentially displaced relative to the stitch means of the other tubular ply, such that any liquid penetrating any hole defined by stitch means of the outer tubular ply must travel circumferentially in order to penetrate any holes defined by stitch means of the inner tubular ply. The reference to circumferential displacement is made due to the roughly cylindrical and hence circular arrangement of the sleeves when worn by a health professional HP.

Preferably, the stitch means of one tubular ply has an optimum circumferential displacement of roughly 180° relative to the other tubular ply. Accordingly, it will be seen in FIG. 3 of the drawings that the stitch means or stitches 32 of the inner tubular ply 31 is displaced circumferentially roughly 180° relative to the stitch means or stitches 34 of the outer tubular ply 30 whereby any liquid penetrating any holes defined by the stitch means of outer ply 30, or the stitches 34 of outer ply 30, must travel circumferentially roughly 180° in order to penetrate any holes defined by the stitch means of the inner tubular ply 31.

It will be appreciated that it is very difficult for any liquid to travel roughly 180° along sleeves 24 as shown. Further, because only small amounts of liquid are involved such small amounts of liquid are not likely to circumferentially travel 180° without being trapped at some position between the outer ply 30 and inner ply 31 before reaching any holes or openings defined by the stitches 32 of the inner ply 31 whereby the chance of any liquid penetrating through the outer ply 30 and inner ply 31 are greatly minimized. The reference to circumferential travel is also intended to mean that liquid travel could be required in either direction about the entire outer surface of the inner ply 31 from stitches 34 to stitches 32.

Each of the plies 26 and 27 of the front panel 22 and each of the plies 30 and 31 of each sleeve 24 is preferably made of woven hydrophobic fabric material and the fabric material is preferably made of woven synthetic yarns each made of a plurality of continuous filaments of synthetic material. The preferred synthetic material defining the continuous filaments of each of the yarns is preferably polyester.

As previously mentioned, the main body 21 of the gown 20 has a pair of substantially similiar side panels each designated by the same reference numeral 23. Each of the side panels 23 is made of a single ply of launderable material preferably in the form of a woven fabric material. The woven fabric material defining each side panel 23 is also preferably a hydrophobic material and the single ply of each side panel 23 is made of woven yarns each consisting of a plurality of continuous filaments made of synthetic material with the synthetic material also being preferably polyester.

Figure 6:
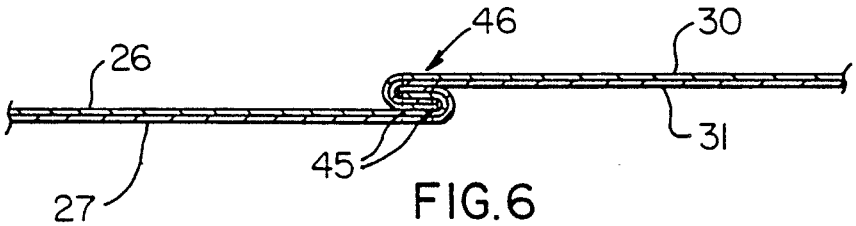
FIG. 6 is a view taken through the front portion of the sleeve and front panel essentially on the line 6—6 of FIG. 4.
Figure 7:
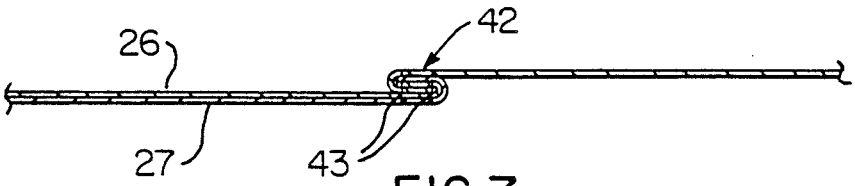
FIG. 7 is a view taken through the front panel and an associated side panel essentially on the line 7—7 of FIG. 4.

Each of the pair of side panels 23, made of a single ply of a woven material as previously mentioned, is fastened to an associated side of the front panel by a stitched seam 42 (FIGS. 4 and 7) made by folding the associated edges of the side panel 23 and front panel 22 in any suitable manner known in the art and utilizing suitable stitches 43. Similarly, each sleeve 24 is suitably fastened to the main body of the gown comprised of the double thickness front panel 22 and side panels 23. Each sleeve 24 is preferably fastened by fastening means in the form of stitch means or stitches 45 extending through an associated seam 46 as illustrated in FIGS. 4 and 6. Each seam 46 is defined by suitably folding its associated double thickness sleeve 24 and front panel 22 as is known in the art. Further, a suitable seam is defined between each sleeve 24 and an associated side panel 23 as shown at 47 in FIG. 4 and may also be fastened by stitches 45 which may continue beyond seam 46. The seam at 47 may be defined in accordance with any suitable technique known in the art.

The gown 20 is defined with a front panel 22, sleeves 24, and side panels 23 in the manner described above; and, it will be appreciated that the front panel 22 has a width 50 such that it provides a double thickness barrier in front of its wearer which is free of any stitch means and any holes produced thereby. Further, each side panel 23 has a width such that the side panels 23 are overlapped at the rear portion of the gown once the gown is worn by a wearer and fastened in position. The overlapping action is basically illustrated by the dotted lines 51 and 52 in FIG. 4 where the dotted line 51 represents the terminal edge of the right side panel 23 as viewed in FIG. 4 and the dotted line 52 represents the terminal edge of the left side panel 23 as viewed in FIG. 4.

The gown 20 is provided with ties or snaps (not shown) of any suitable type known in the art to enable such gown to be attached in position when worn by a health professional HP so that the front panel 22 and side panels 23 are wrapped around a wearer.

Each of the sleeves 24 terminates in a cuff 25 at the terminal outer end thereof. Each cuff 25 is preferably a stretchable cuff and has an end portion inverted on itself to define an outer stretchable folded end adjoined by two tubular portions terminating in cuff inner ends which are suitably fastened in position by the usual stitch means, and as is known in the art. The stretchable cuff 25 is preferably made of a stockinette tubular material and the stockinette tubular material may be synthetic material in the form of a polyester or other suitable material as is known in the art.

In normal use the gown 20 would be worn by a health professional HP with rubber gloves 54, or the like, as shown in FIG. 1 which are fluid impervious gloves 54. The rubber gloves 54 are each of substantial length, each covering the entire cuff 25 and extending vertically upwardly over the lower end portion of its two-ply sleeve 24 whereby a surgeon or surgical assistant utilizing the gown 20 and surgical gloves would be afforded improved protection.

The gown 20 with its components 22, 23, 24, and 25 together with the associated ties is preferably made of woven fabric material which is preferably a hydrophobic material and such fabric material is a launderable hydrophobic material. The manner of treating the component parts of the gown 20 to provide optimum hydrophobic properties would be in accordance with any technique known in the art.

However, it will be appreciated that the front panel 22 with its two plies 26 and 27, each sleeve 24 with its two plies 30 and 31, and the side panels 23 may all be made of nonwoven material and the nonwoven material may be disposable material. Further, in the case of nonwoven material, whether disposable or not, stitch means or stitches may be provided in a similar manner as described herein for holding the gown components together and for essentially the same reasons as previously presented.

The gown 20 is preferably in the form of a launderable gown and such launderable gown is capable of providing improved performance against liquids passing through its front panel and sleeves even after as many as approximately one hundred so-called institutional laundry cycles wherein each institutional laundry cycle comprises washing, drying, and steam sterilization.

In this disclosure of the invention, terms such as inner, outer, left, right, etc. have been used throughout; however, it is to be understood that these terms have been used for ease of description presentation and should not be considered as limiting the scope of this invention in any way.

While forms and methods of this invention, now preferred, have been illustrated and described as required by the Patent Statute, it is to be understood that other forms and method steps can be utilized and still fall within the scope of the appended claims wherein each claim sets forth therein what is believed to be known in the art prior to this invention in that portion of each claim that is presented before the term "the improvement" and sets forth what is believed to be new in the art according to this invention in that portion of each claim that is presented after the term "the improvement" wherein it is believed that each claim sets forth a novel, useful, and unobvious invention within the purview of the Patent Statute.

What is claimed is:

1. In a hospital-type gown having a main body comprised of a front panel with a pair of side panels on opposite sides of said front panel and a pair of sleeves fastened to said panels and each terminating in a cuff at a terminal outer end thereof, the improvement in which said front panel and each of said sleeves comprises a plurality of plies, said plurality of plies serving as an improved barrier against liquids passing therethrough yet being breathable, said front panel and each of said sleeves is made of a woven fabric material, said plurality of plies of each sleeve consists of two tubular plies with each tubular ply being made from a single sheet disposed in tubular form and fastened by fastening means, said fastening means fastening each tubular ply is in the form of stitch means, said stitch means of each tubular ply extends longitudinally along its sleeve, and the stitch means of one tubular ply is circumferentially displaced relative to the stitch means of the other tubular ply such that any liquid penetrating any holes defined by stitch means of the outer tubular ply must travel circumferentially in order to penetrate any holes defined by stitch means of the inner tubular ply.

2. A gown as set forth in claim 1 in which the stitch means of one tubular ply has an optimum circumferential displacement of roughly 180° relative to the other tubular ply.

3. A gown as set forth in claim 2 in which said woven fabric material is made of woven synthetic yarns each made of yarns each consisting of a plurality of continuous filaments made of synthetic material.

4. A gown as set forth in claim 3 in which said synthetic material defining said filament yarns and fabric is polyester.

5. A gown as set forth in claim 1 in which each of said pair of side panels is made of a single ply of woven fabric material and each of said pair of side panels is fastened to an associated side of said front panel by a stitched vertical seam which extends substantially the full vertical height of said gown from adjacent an associated sleeve to the bottom edge of said gown.

6. In a launderable surgical gown having a main body comprised of a front panel with a pair of side panels on opposite sides of said front panel and a pair of sleeves fastened to said panels and each terminating in a cuff at a terminal outer end thereof, the improvement in which said front panel and each of said sleeves comprises a plurality of plies of hydrophobic material, aid plurality of plies serving as an improved barrier against liquids passing therethrough yet being breathable, said front panel and each sleeve is made of a woven fabric material and said woven fabric material is made of woven synthetic yarns each made of a plurality of continuous filaments made of synthetic material, said synthetic material defining said filament yarns and fabric is polyester, said plurality of plies of each sleeve consists of two tubular plies with each tubular ply being made from a single sheet disposed in tubular form and fastened by stitch means, said stitch means of each tubular ply extends longitudinally along its sleeve and the stitch means of one tubular ply is circumferentially displaced relative to the stitch means of the other tubular ply such that any liquid penetrating any holes defined by stitch means of the outer tubular ply must travel circumferentially in order to penetrate any holes defined by stitch means of the inner tubular ply.

7. A gown as set forth in claim 6 in which the stitch means of one tubular ply has an optimum circumferential displacement of roughly 180+ relative to the other tubular ply.

8. A gown as set forth in claim 7 in which said front panel has a width such that when said gown is worn it provides a double-thickness barrier at the front of its wearer free of any stitch means and any holes produced thereby.

9. A gown as set forth in claim 7 in which each of said pair of side panels is made of a single ply of woven fabric material and is fastened to an associated side of said front panel by stitch seam and said front panel has a width such that each stitched seam is disposed behind a wearer of said gown.

10. A gown as set forth in claim 9 in which said cuff is a double-thickness stretchable cuff.

11. In a method of making a hospital-type gown comprising the steps of providing a front panel to comprise a main body of said gown, attaching a pair of side panels on opposite sides of said front panel to complete said main body, and fastening a pair of sleeves to said panels with each sleeve terminating in a cuff at a terminal outer end thereof, the improvement in which said step of providing a front panel comprises providing said front panel made of a plurality of plies and said step of fastening said pair of sleeves comprises fastening said sleeves each comprised of a plurality of plies, said plurality of plies serving as an improved barrier against liquids passing therethrough yet being breathable, and said method comprising the preparation steps of making said front panel and each of said sleeves of woven fabric material, said plurality of pies of each sleeve consisting of two tubular plies with each tubular ply being made from a single sheet disposed in tubular form and fastened by fastening means in the form of stitch means, said stitch means of each tubular ply extending longitudinally along its sleeve and the stitch means of one tubular ply being circumferentially displaced relative to the stitch means of the other tubular ply such that in the resulting gown defined by said method any liquid penetrating any holes defined by stitch means of the outer tubular ply must travel circumferentially in order to penetrate any holes defined by stitch means of the inner tubular ply.

12. A method as set forth in claim 11 and comprising the further step of displacing the stitch means of one tubular ply through a circumferential displacement of roughly 180°.

13. In a hospital-type gown having a main body and a pair of sleeves fastened to said main body and each terminating in a cuff at a terminal outer end thereof, the improvement in which each of said sleeves comprises a plurality of plies, said plurality of plies serving as an improved barrier against liquids passing therethrough yet being breathable, said plurality of piles of each sleeve comprises two tubular plies with each tubular ply being made from a single sheet disposed in tubular form and fastened by fastening means in the form of stitch means, said stitch means of each tubular ply extends longitudinally along its sleeve, and the stitch means of one tubular ply is circumferentially displaced relative to the stitch means of the other tubular ply such that any liquid penetrating any holes defined by stitch means of the outer tubular ply must travel circumferentially in order to penetrate nay holes defined by stitch means of the inner tubular ply.

14. A gown as set forth in claim 13 in which said main body is comprised of a front panel and a pair of side panels on opposite sides of said front panel, said front panel being comprised of a plurality of plies, and said sleeves being fastened to said panels.

15. A gown as set forth in claim 14 in the form of a surgical gown.

16. A gown as set forth in claim 14 in which said front panel and each of said sleeves is made of a woven fabric material.

17. A gown as set forth in claim 14 in which said front panel and each of said sleeves is made of a nonwoven material.

18. A gown as set forth in claim 17 in which said nonwoven material is a disposable material.

19. A gown as set forth in claim 14 in which said plurality of plies of said sleeves and front panel are nonlaminated plies.

* * * * *